US008794546B2

(12) United States Patent
Eley et al.

(10) Patent No.: US 8,794,546 B2
(45) Date of Patent: Aug. 5, 2014

(54) ADJUSTABLE SPRAYER

(75) Inventors: Craig D. Eley, Lincoln, NE (US); Darin Schollmeyer, Creighton, NE (US)

(73) Assignee: Eley Corporation, Lincoln, NE (US)

( * ) Notice: Subject to any disclaimer, the term of this patent is extended or adjusted under 35 U.S.C. 154(b) by 293 days.

(21) Appl. No.: 13/339,054

(22) Filed: Dec. 28, 2011

(65) Prior Publication Data

US 2013/0168474 A1 Jul. 4, 2013

(51) Int. Cl.

| | |
|---|---|
| ***B05B 1/32*** | (2006.01) |
| ***B05B 1/16*** | (2006.01) |
| ***B05B 1/14*** | (2006.01) |
| ***B05B 1/12*** | (2006.01) |
| ***A62C 31/03*** | (2006.01) |

(52) U.S. Cl.

USPC ..... 239/456; 239/438

(58) Field of Classification Search

CPC ..... B05B 1/06; B05B 1/12; B05B 1/14; B05B 1/16; B05B 1/609; B05B 1/1636; B05B 1/1663; B05B 1/1681; B05B 1/18; B05B 1/3033; B05B 1/3086; B05B 7/02; B05B 7/12

USPC ..... 239/390–392, 394, 436–441, 451, 456, 239/457, 460, 525, 541

See application file for complete search history.

(56) References Cited

U.S. PATENT DOCUMENTS

| | | | | | |
|---|---|---|---|---|---|
| 582,051 | A * | 5/1897 | Fuerbringer | ..... | 239/441 |
| 2,944,743 | A * | 7/1960 | Kachergis | ..... | 239/458 |
| 3,058,670 | A * | 10/1962 | Marotto et al. | ..... | 239/428.5 |
| 3,514,042 | A * | 5/1970 | Freed | ..... | 239/458 |
| 3,784,112 | A * | 1/1974 | Collignon | ..... | 239/443 |
| 4,095,747 | A * | 6/1978 | Anderson | ..... | 239/288.5 |
| 4,714,200 | A * | 12/1987 | Sayama | ..... | 239/579 |
| 5,242,116 | A * | 9/1993 | Bonezzi | ..... | 239/438 |
| 6,481,643 | B1 * | 11/2002 | Chen | ..... | 239/390 |
| 7,543,762 | B1 * | 6/2009 | Cheng | ..... | 239/438 |

* cited by examiner

*Primary Examiner* — Darren W Gorman

(74) *Attorney, Agent, or Firm* — Perkins Coie LLP

(57) ABSTRACT

An adjustable sprayer comprising a fitting that includes a connector portion, an elongate cylindrical portion extending from the connector portion, and a bore formed longitudinally through the fitting. The sprayer includes a nozzle having a sleeve portion configured to receive the fitting's cylindrical portion whereby the nozzle is moveable, longitudinally, along the cylindrical portion between first and second spray positions. The nozzle includes a primary outlet and at least one secondary outlet radially spaced from the primary outlet. The cylindrical portion is in fluid communication with only the primary outlet when the nozzle is in the first spray position, and the cylindrical portion is in fluid communication with both the primary and secondary outlets when the nozzle is in the second spray position.

18 Claims, 9 Drawing Sheets

ADJUSTABLE SPRAYER

BACKGROUND

Watering nozzles known as water breakers are a favorite for gardening enthusiast and professionals for quickly watering potted or bedded plants. Water breakers deliver a large amount of water in a soft shower pattern. The typical water breaker is adequate if the user is close enough to reach the plants. However, to water plants with the same soft shower pattern from a further distance the user must get closer to the plant or change nozzles. In either case it is inconvenient and inefficient way to water a large area. Furthermore, nozzles designed to reach a further distance will disrupt the soil, especially if used up close, thereby defeating the purpose of a water breaker type sprayer.

Accordingly, there is a need for an adjustable sprayer capable of delivering the same soft volume of water that a normal water breaker delivers yet can adjust to deliver that spray further to reach plants that would normally require repositioning or changing the nozzle to a different style.

SUMMARY

Provided herein is an adjustable sprayer capable of delivering the same soft volume of water that a normal water breaker delivers yet can adjust to deliver that spray further to reach plants that would normally require repositioning or changing the nozzle to a different style. According to an embodiment, the adjustable sprayer comprises a fitting that includes a connector portion, an elongate cylindrical portion extending from the connector portion, and a bore formed longitudinally through the fitting. The connector portion includes threads mateable with a garden hose. The sprayer includes a nozzle connected to the fitting.

The nozzle includes a sleeve portion configured to receive the fitting's cylindrical portion whereby the nozzle is moveable, longitudinally, along the cylindrical portion between first and second spray positions. In an embodiment, the nozzle is rotatably disposed on the cylindrical portion. The sprayer includes an o-ring seal disposed inside the sleeve portion and operative to provide a seal between the cylindrical portion and the sleeve portion. The nozzle includes a primary outlet and at least one secondary outlet radially spaced from the primary outlet. The cylindrical portion is in fluid communication with only the primary outlet when the nozzle is in the first spray position, and the cylindrical portion is in fluid communication with both the primary and secondary outlets when the nozzle is in the second spray position.

The cylindrical portion of the fitting is adapted to seal with the cylindrical ring when the nozzle is in the first spray position. An o-ring seal may be disposed inside the cylindrical ring. Alternatively, the cylindrical portion and the cylindrical ring include mating frustoconical sealing surfaces.

In an embodiment, the primary outlet and the at least one secondary outlets are concentric with each other. The nozzle includes a surrounding sidewall extending from the sleeve portion defining an interior region. The surrounding sidewall may diverge from the sleeve portion. The primary outlet comprises a cylindrical ring supported in the interior region. In an embodiment, the cylindrical ring is supported in the interior region by a plurality of radially extending stanchions. The secondary outlet comprises the area between the surrounding sidewall and the cylindrical ring. The sprayer also includes a perforated screen disposed adjacent to the primary and secondary outlets.

The adjustable sprayer may also include a retaining ring disposed in the sleeve portion, and wherein the cylindrical portion includes a plurality of longitudinally spaced detent grooves adapted to receive the retaining ring. The detent grooves adapted to receive the retaining ring and corresponding to the first and second spray positions respectively.

These and other aspects of the adjustable sprayer will be apparent after consideration of the Detailed Description and Figures herein.

DRAWINGS

Non-limiting and non-exhaustive embodiments of the adjustable sprayer, including the preferred embodiment, are described with reference to the following figures, wherein like reference numerals refer to like parts throughout the various views unless otherwise specified.

Figure 1:
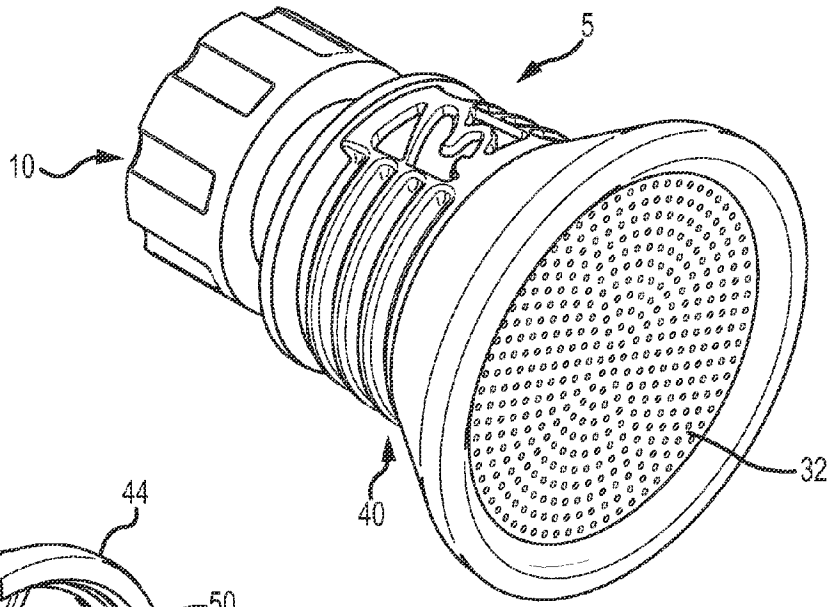
FIG. 1 is a perspective view of an adjustable sprayer according to a first exemplary embodiment.
Figure 2:
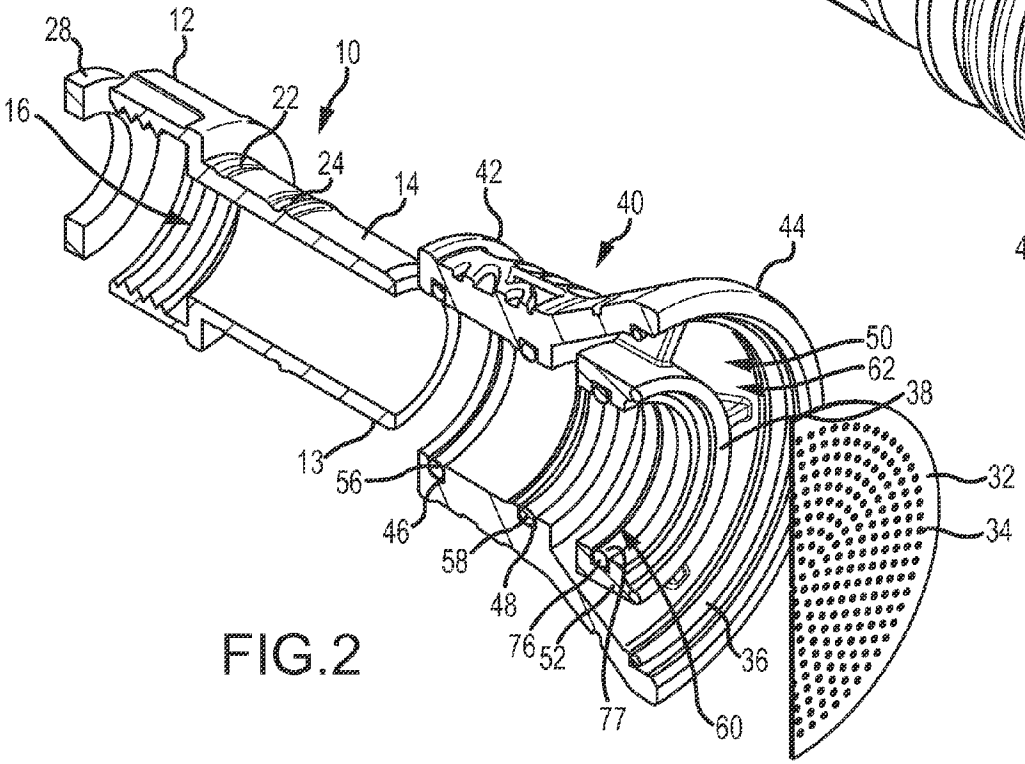
FIG. 2 is an exploded cross-sectional view of the adjustable sprayer shown in FIG. 1.
Figure 3:
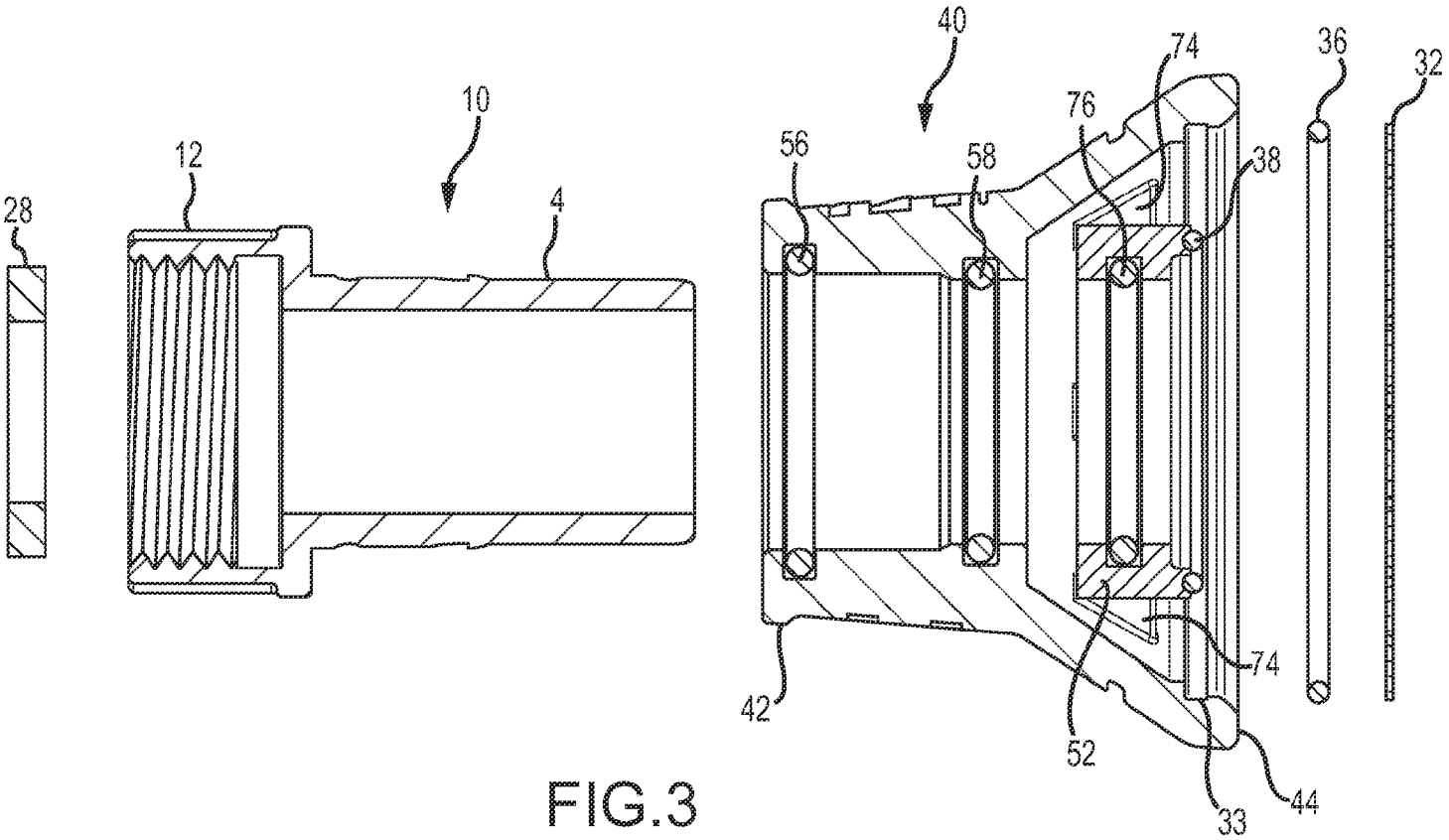
FIG. 3 is an exploded side view of the adjustable sprayer shown in FIGS. 1 and 2.
Figure 4A:
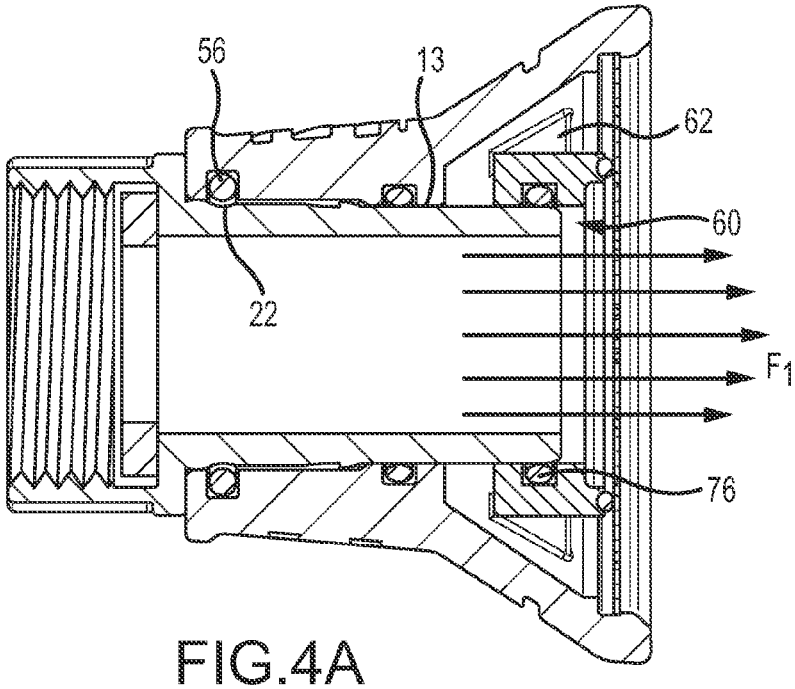
Figure 4B:
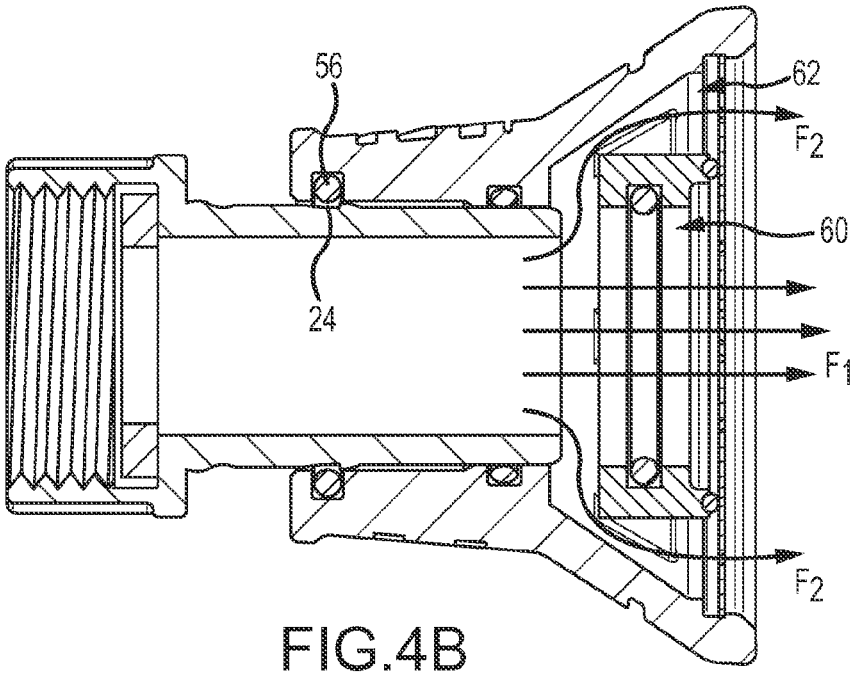
Figure 5:
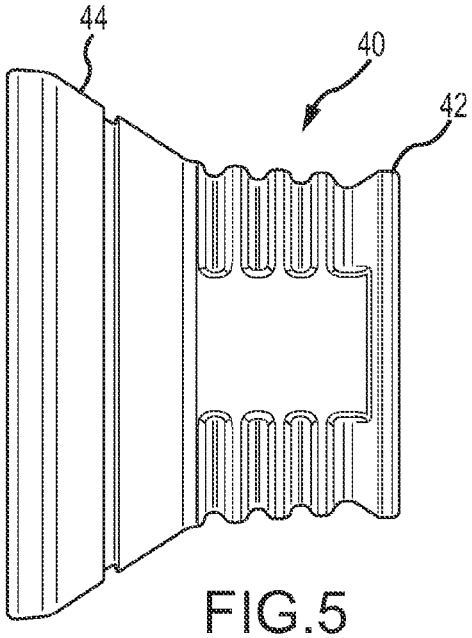
Figure 6:
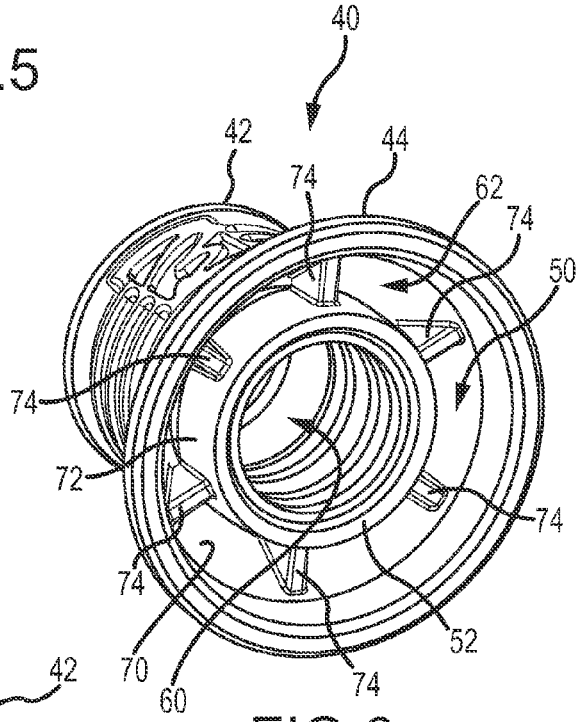
Figure 7:
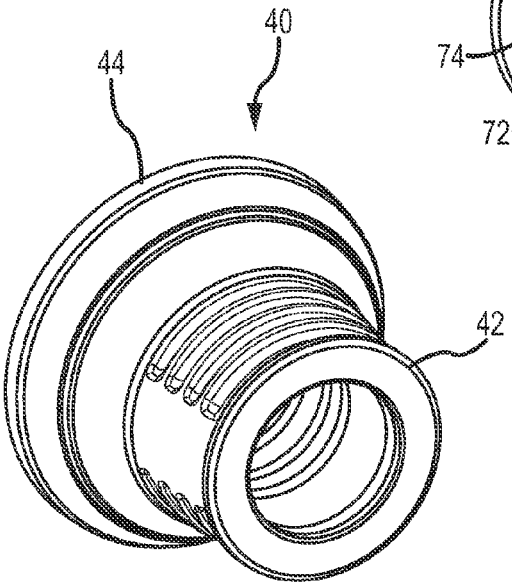
Figure 8:
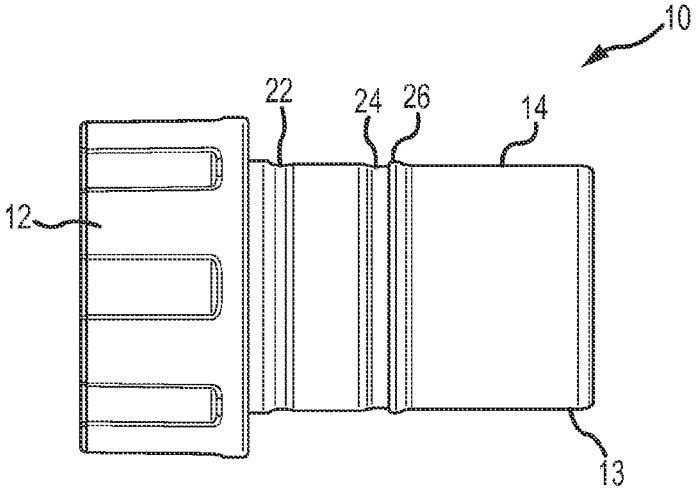
Figure 9:
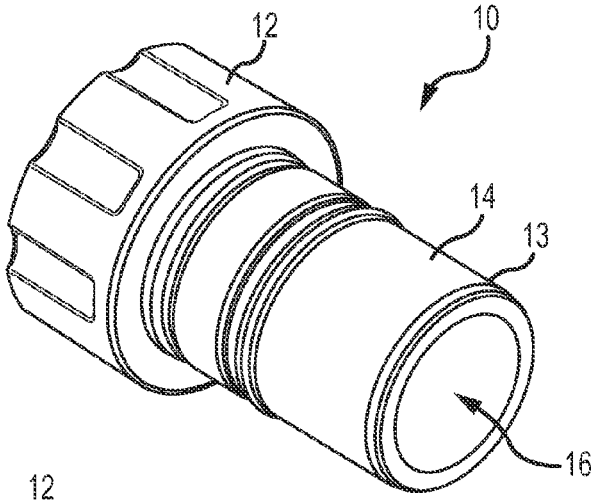
Figure 10:
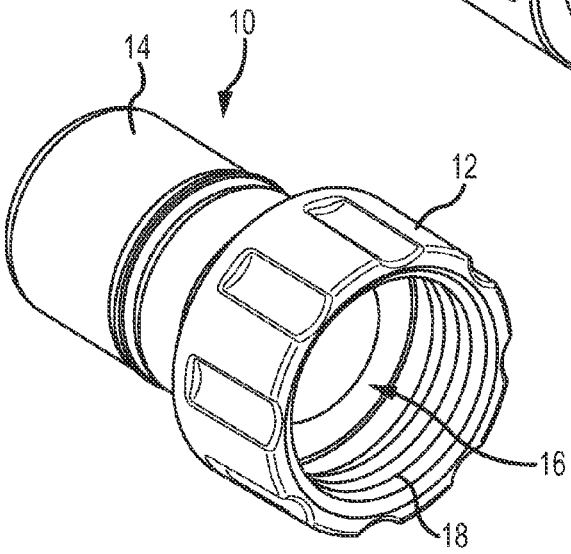
Figure 11:
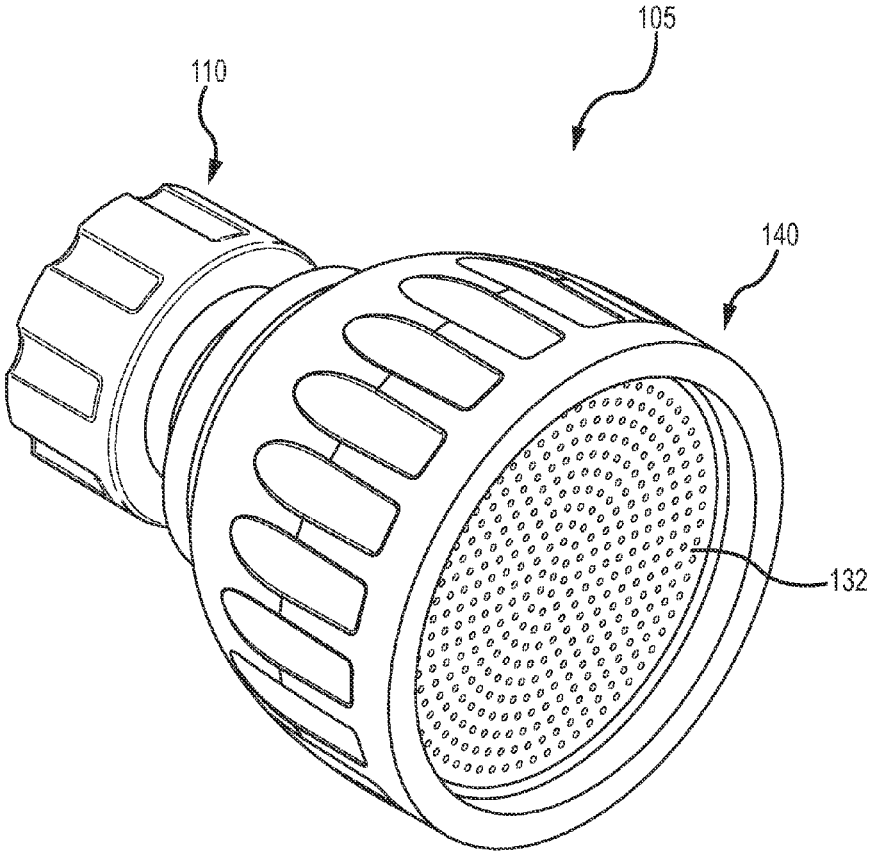
Figure 12:
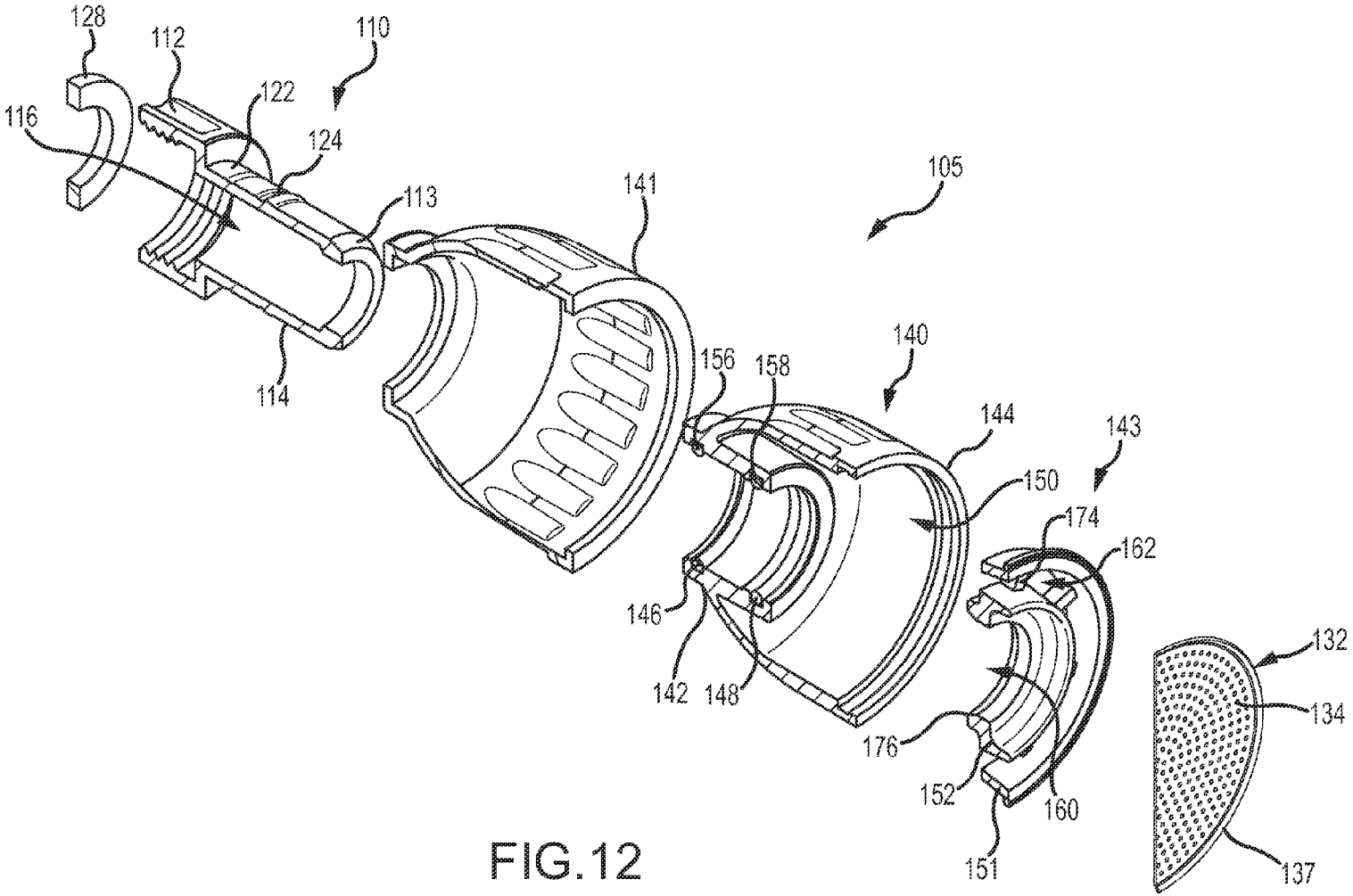
Figure 13A:
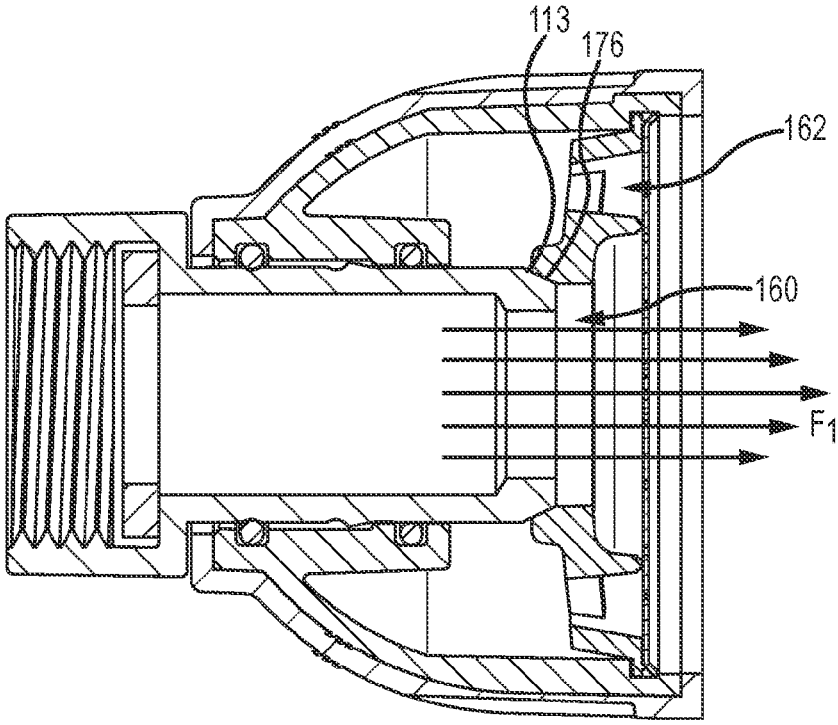
Figure 13B:
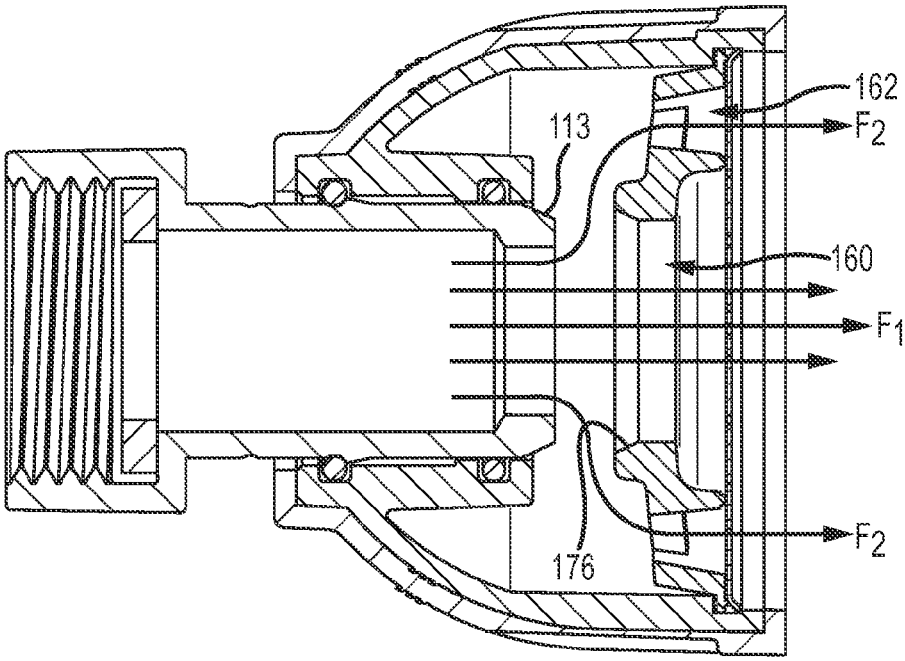
Figure 14:
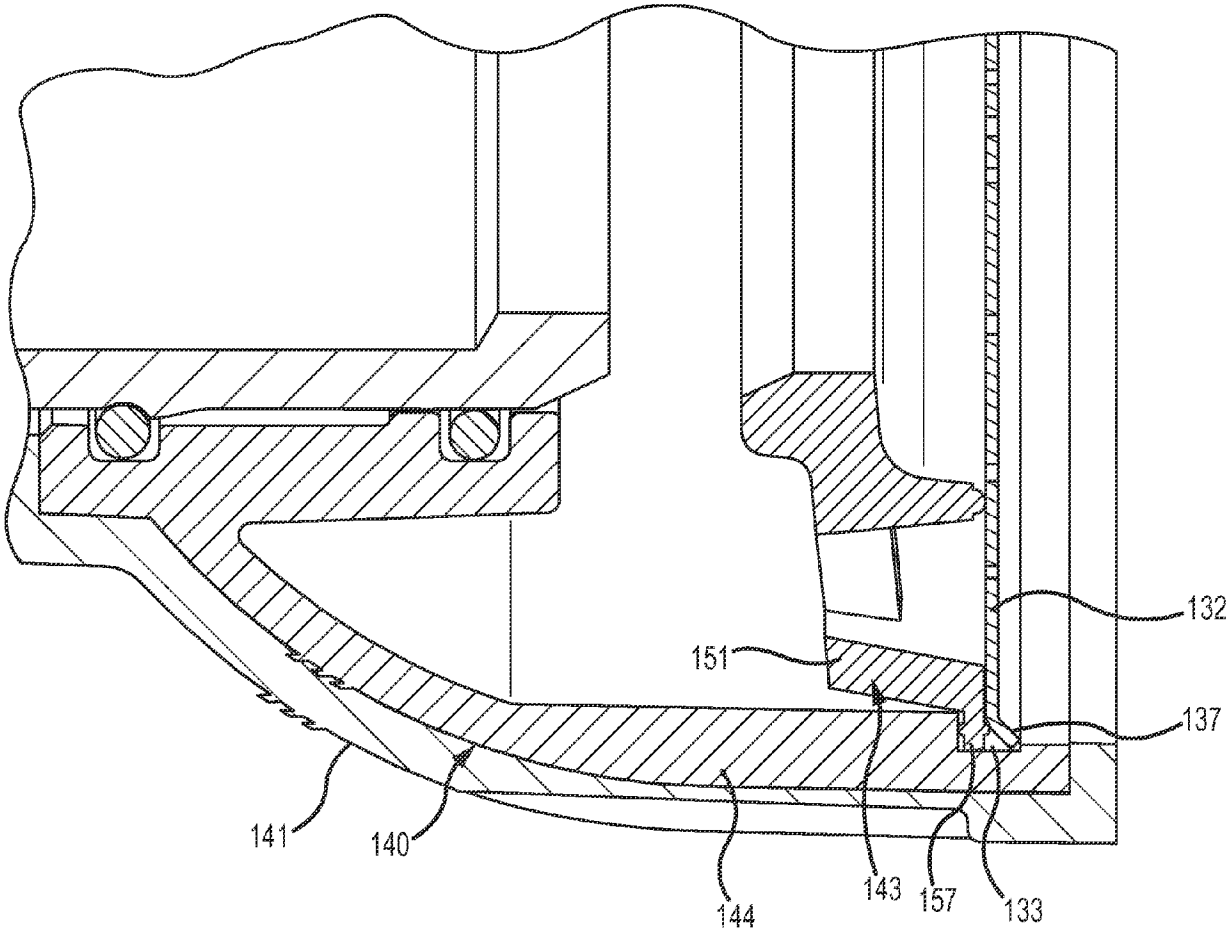

FIG. 4*a* is a cross-sectional side view of the adjustable sprayer shown in FIGS. 1-3 in a first spray position;

FIG. 4*b* is a cross-sectional side view of the adjustable sprayer shown in FIG. 4*a* in a second spray position;

FIG. 5 is a side view in elevation of the nozzle;

FIG. 6 is a perspective view of the nozzle as viewed from the front;

FIG. 7 is a perspective view of the nozzle as viewed from the back;

FIG. 8 is a side view in elevation of the fitting;

FIG. 9 is a perspective view as viewed from the front of the fitting shown in FIG. 8;

FIG. 10 is a perspective view of the fitting as viewed from the back;

FIG. 11 is an adjustable sprayer according to a second exemplary embodiment;

FIG. 12 is an exploded cross-section in perspective of the adjustable sprayer shown in FIG. 11;

FIG. 13*a* is a side view in cross-section of the adjustable sprayer shown in FIG. 12 in a first spray position;

FIG. 13*b* is a cross-sectional side view of the adjustable sprayer shown in FIG. 12 in a second spray position; and FIG. 14 is a partial cross-section illustrating the assembly of the perforated screen and nozzle insert.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

The adjustable sprayer 5, shown in FIG. 1, includes a fitting 10 with a nozzle 40 attached thereto. Nozzle 40 also includes a perforated screen 32, which is sometimes referred to as a water breaker. With further reference to FIG. 2, the fitting 10 includes a connector portion 12 with an elongate cylindrical portion 14 extending therefrom. A bore 16 is formed longitudinally through the fitting. Connector portion 12 may receive a washer 28. For instance, washer 28 may be comprised of rubber to provide a seal between a garden hose and the connector portion.

Nozzle 40 includes a sleeve portion 42 that is configured to receive the cylindrical portion 14 whereby the nozzle is moveable longitudinally along the cylindrical portion between first and second spray positions. Nozzle 40 also includes a surrounding sidewall 44 and a cylindrical ring 52 supported in the interior 50 of the surrounding sidewall 44. Surrounding side wall 44 extends from sleeve portion 42. In this case, surrounding side wall 44 diverges away from the sleeve portion. In this embodiment, cylindrical ring 52 is supported in the interior 50 of surrounding sidewall 44 by a plurality of radially extending stanchions 74. Thus, nozzle 40 includes a primary outlet 60 and at least one secondary outlet 62 radially spaced from the primary outlet. Primary outlet 60 is defined by the interior of ring 52, whereas the secondary outlet is defined by the inner surface 70 of surrounding sidewall 44 and the outer surface 72 of cylindrical ring 52 (see FIG. 6).

Perforated screen 32 includes a plurality of holes 34 through which water is sprayed. With reference to FIG. 3, the perforated screen 32 snaps into groove 33 of nozzle 40. Groove 33 also accommodates an O-ring 36 against which the perforated screen 32 seals. Perforated screen 32 also seals against O-ring 38 which is supported by cylindrical ring 52.

Sleeve portion 42 includes a retaining ring groove 46 in which resides a retaining ring 56. In this case, retaining ring 56 may be a snap ring of metal construction. Sleeve portion 42 also includes an O-ring groove or seal groove 48 within which is disposed an O-ring 58. Accordingly, the elongate cylindrical portion 14 of fitting 10 is sealed against the O-ring 58 when inserted into the sleeve portion 42. Retaining ring 56 is operative to engage detent grooves 22, 24 formed around the outside of the elongate cylindrical portion. It should be understood that the nozzle 40 may rotate about the cylindrical portion.

Referring to FIGS. 4*a* and 4*b*, the first and second spray positions may be more fully understood. In FIG. 4*a*, the adjustable sprayer is shown in a first spray position in which the cylindrical portion 14 is in fluid communication with only the primary outlet 60. When the nozzle is in the first spray position, O-ring 76, which is disposed within O-ring groove or seal groove 77, seals against an end portion 13 of fitting 10. Accordingly, fluid flowing from the adjustable sprayer is directed through only the primary outlet 60 as indicated by arrows F1. As shown in FIG. 4*b*, when the nozzle is in the second spray position, fluid is allowed to flow through both the primary outlet 60 and the secondary outlet 62. Fluid flowing from the primary outlet 60 is indicated by arrows F1, and fluid flowing through the secondary outlet is indicated by arrows F2. It can also be appreciated in FIGS. 4*a* and 4*b* that the nozzle is retained in the first and second spray positions when retaining ring 56 engages a respective detent groove 22 or 24.

The nozzle 40, as shown in FIG. 5, includes a sleeve portion 42 from which extends a diverging surrounding side wall 44. The surrounding side wall 44 defines an interior region 50 in which is supported a cylindrical ring 52. Cylindrical ring 52 defines the primary outlet 60 while the secondary outlet (or outlets) 62 is defined as the region between the inner surface 70 of surrounding side wall 44 and outer surface 72 of cylindrical ring 52. In this embodiment, cylindrical ring 52 is supported in the interior region 50 by a plurality of stanchions 74.

The fitting 10, as shown in FIG. 8, includes connector portion 12 and an elongate cylindrical portion 14 extending from the connector portion 12. Elongate cylinder 14 has an end portion 13 and a bore 16 formed through the fitting. Cylindrical portion 14 also includes a plurality of detent grooves. In this case, the cylindrical portion 14 includes two detent grooves 22, 24 which correspond respectively to first and second spray positions. Cylindrical portion 14 also includes a barb 26 adjacent detent groove 24. Barb 26 inhibits removal of nozzle 40 from fitting 10. As shown in FIG. 10, the connector portion 12 includes threads 18 configured for attachment to a garden hose, for instance.

An adjustable sprayer 105 according to a second exemplary embodiment is shown in FIG. 11. Adjustable sprayer 105 also includes a fitting 110 and a nozzle 140 disposed on the fitting. Nozzle 140 also includes a water breaker in the form of a perforated screen 132, which includes a plurality of holes 134 through which water is sprayed. With reference to FIG. 12, it can be appreciated that adjustable sprayer 105 is similar to the embodiment described above with respect to FIGS. 1-10. However, in this case, the nozzle 140 also includes a cover 141 and an outlet insert 143. As above, the nozzle 140 includes a sleeve portion 142 from which extends the surrounding side wall 144 defining an interior 150. The outlet insert 143 is disposed in the interior 150. Outlet insert 143 includes an outer ring 151 and an inner ring 152. The inner ring 152 is supported within the outer ring 151 by a plurality of stanchions 174. In this case, the primary outlet 160 is defined by the interior of inner ring 152. Secondary outlets 162 are defined by the region between the inner ring 152 and the outer ring 151.

Fitting 110 of adjustable sprayer 105 is similar to that as described above, in that it includes a connector portion 112 from which extends a cylindrical portion 114. In this case, however, fitting 110 includes a frustoconical end portion 113 which is adapted to mate with a mating frustoconical surface 176 formed in inner ring 152. With further reference to FIG. 12, nozzle 140 includes a sleeve portion having a retaining ring groove 146 in which resides a retaining ring 156. Retaining ring 156 may be a snap ring of metal construction. The sleeve portion of nozzle 140 also includes an O-ring groove or seal groove 148 within which is disposed an O-ring 158. Accordingly, an elongate cylindrical portion of fitting 110 is sealed against the O-ring 158 when inserted into the sleeve portion of the nozzle 140. Retaining ring 156 is operative to engage detent grooves 122, 124 formed around the outside of the elongate cylindrical portion. It should be understood that the nozzle 140 may rotate about the cylindrical portion. With further reference to FIG. 13*a*, it can be appreciated that when the nozzle is in the first spray position, frustoconical mating surfaces 113 and 176 provide a seal between the end portion 113 and inner ring 152. Accordingly, when in the first spray position, fluid flows only through the primary outlet 160. With reference to FIG. 13*b*, when the nozzle is in the second spray position, fluid is allowed to flow through both primary outlet 160 indicated by arrows F1 as well as through secondary outlets 162 indicated by arrows F2.

FIG. 14 illustrates the installation of outlet insert 143 into surrounding side wall 144. Outer ring 151 of the outlet insert 143 includes a flange 157 which is disposed in groove 133 formed around the interior of surrounding side wall 144. The outlet insert 143 is retained in groove 133 by perforated screen 132. Perforated screen 132 includes a surrounding flange 137 which may be pressed into the groove 133 against flange 157 to engage an edge of groove 133, thereby retaining both the perforated screen 132 and the outlet insert 143 in the nozzle 140.

The adjustable sprayers described herein may be comprised of various materials as one of ordinary skill in the art can appreciate. For example, the fitting 10, 110 may be comprised of metal such as brass, aluminum, or steel. Alternatively, fitting 10 may be comprised of molded plastic such as ABS. Nozzle 40, 140 may be comprised of brass, aluminum, or steel such as in the case of the fitting. Also, the nozzle may be comprised of plastic such as ABS. The nozzle cover 141 may be comprised of a suitable material which may be either molded onto nozzle 140 or forcibly installed over the nozzle. Accordingly, nozzle cover 141 may be comprised of a hard rubber or other suitably flexible material. The components described herein may be molded or machined, for example.

Also contemplated herein are methods of varying the spray from a nozzle. The methods thus encompass the steps inherent in the above described structures and operation thereof. Although the technology and methods of using and/or applying the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (ex., 3, 5.8, 9.9994, and so forth).

What is claimed is:

1. An adjustable sprayer, comprising:

a fitting including a connector portion, an elongate cylindrical portion extending from the connector portion, and a bore formed longitudinally through the fitting;

a nozzle including a sleeve portion configured to receive the cylindrical portion whereby the nozzle is moveable, longitudinally, along the cylindrical portion between first and second spray positions, the nozzle including a primary outlet and at least one secondary outlet radially spaced from the primary outlet a water breaker, having a plurality of openings, disposed adjacent to the primary outlet and at least one secondary outlet; a terminal end portion of the primary outlet being in sealing contact with the water breaker; and wherein the cylindrical portion is in fluid communication with only the primary outlet, and a portion of the openings in the water breaker, when the nozzle is in the first spray position, and wherein the cylindrical portion is in fluid communication with the primary outlet, the at least one secondary outlet, and substantially all of the openings in the water breaker, when the nozzle is in the second spray position.

2. The sprayer according to claim 1, wherein the primary outlet and the at least one secondary outlet are concentric.

3. The sprayer according to claim 1, wherein the nozzle includes a surrounding sidewall extending from the sleeve portion defining an interior region, and wherein the primary outlet comprises a cylindrical ring supported in the interior region.

4. The sprayer according to claim 3, wherein the at least one secondary outlet comprises the area between the surrounding sidewall and the cylindrical ring.

5. The sprayer according to claim 3, wherein the cylindrical portion is adapted to seal with the cylindrical ring when the nozzle is in the first spray position.

6. The sprayer according to claim 5, further comprising an o-ring seal disposed inside the cylindrical ring.

7. The sprayer according to claim 3, wherein the cylindrical ring is supported by a plurality of radially extending stanchions.

8. The sprayer of claim 1, wherein the connector portion includes threads mateable with a garden hose.

9. The sprayer of claim 1, wherein the nozzle is rotatably disposed on the cylindrical portion.

10. An adjustable sprayer, comprising:

a fitting including a connector portion, an elongate cylindrical portion extending from the connector portion, and a bore formed longitudinally through the fitting;

a nozzle including a sleeve portion configured to receive the cylindrical portion whereby the nozzle is moveable, longitudinally, along the cylindrical portion between first and second spray positions, the nozzle including a primary outlet and at least one secondary outlet radially spaced from the primary outlet;

a retaining ring disposed in the sleeve portion, wherein the cylindrical portion includes a plurality of longitudinally spaced detent grooves adapted to receive the retaining ring; and wherein the cylindrical portion is in fluid communication with only the primary outlet when the nozzle is in the first spray position, and wherein the cylindrical portion is in fluid communication with both the primary and at least one secondary outlets when the nozzle is in the second spray position.

11. The sprayer of claim 1, wherein the water breaker is a perforated screen, and wherein the plurality of openings are uniformly sized and spaced-apart openings across a face of the water breaker.

12. An adjustable sprayer, comprising:

a fitting including a connector portion, an elongate cylindrical portion extending from the connector portion, and a bore formed longitudinally through the fitting;

a nozzle including a sleeve portion configured to receive the cylindrical portion whereby the nozzle is moveable along the cylindrical portion between first and second spray positions, the nozzle including a surrounding sidewall extending from the sleeve portion defining an interior region;

a primary outlet in the form of a cylindrical ring supported in the interior region;

a secondary outlet comprising the area between the surrounding sidewall and the cylindrical ring; and wherein the cylindrical portion is adapted to seal with the cylindrical ring when the nozzle is in the first spray position, whereby the cylindrical portion is in fluid communication with only the primary outlet, and wherein a terminal end of the cylindrical portion is spaced rearwardly from the cylindrical ring, within the interior region of the nozzle, in fluid communication with both the primary and secondary outlets when the nozzle is in the second spray position, whereby a fluid pathway extends from the terminal end of the cylindrical portion to the interior region of the nozzle and then through the primary and secondary outlets.

13. An adjustable sprayer, comprising:

a fitting including a connector portion, an elongate cylindrical portion extending from the connector portion, and a bore formed longitudinally through the fitting;

a nozzle including a sleeve portion configured to receive the cylindrical portion whereby the nozzle is moveable along the cylindrical portion between first and second spray positions, the nozzle including a surrounding sidewall extending from the sleeve portion defining an interior region;

a retaining ring disposed in the sleeve portion, wherein the cylindrical portion includes first and second longitudinally spaced detent grooves adapted to receive the retaining ring and corresponding to the first and second spray positions respectively;

a primary outlet in the form of a cylindrical ring supported in the interior region;

a secondary outlet comprising the area between the surrounding sidewall and the cylindrical ring; and wherein the cylindrical portion is adapted to seal with the cylindrical ring when the nozzle is in the first spray position, whereby the cylindrical portion is in fluid communication with only the primary outlet, and wherein the cylindrical portion is in fluid communication with both the primary and secondary outlets when the nozzle is in the second spray position.

14. The sprayer of claim 12, wherein the surrounding sidewall diverges from the sleeve portion.

15. The sprayer according to claim 12, further comprising an o-ring seal disposed inside the cylindrical ring.

16. The sprayer according to claim 12, wherein the terminal end of the cylindrical portion includes a frustoconical sealing surface and an end portion of the cylindrical ring includes a frustoconical sealing surface; the frustoconical sealing surface of the cylindrical portion and the frustoconical sealing surface of the cylindrical ring being positioned to come into sealing engagement with one another when the nozzle is in the first spray position, substantially preventing fluid from flowing from within the cylindrical portion through the secondary outlet.

17. The sprayer of claim 12, further comprising a perforated screen disposed adjacent to the primary and secondary outlets; a terminal end portion of the primary outlet being in sealing contact with the perforated screen.

18. The sprayer according to claim 12, further comprising an o-ring seal disposed inside the sleeve portion and operative to provide a seal between the cylindrical portion and the sleeve portion.

* * * * *